US006343198B1

(12) United States Patent
Sato

(10) Patent No.: US 6,343,198 B1
(45) Date of Patent: Jan. 29, 2002

(54) IMAGE FORMING APPARATUS INCLUDING INTERLOCKING LIGHT EMITTING AND RECEIVING PORTIONS

(75) Inventor: Toshiya Sato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/649,050

(22) Filed: Aug. 29, 2000

(30) Foreign Application Priority Data

Aug. 30, 1999 (JP) ..... 11-242488

(51) Int. Cl.[7] ..... G03G 15/01
(52) U.S. Cl. ..... 399/121; 399/299
(58) Field of Search ..... 399/110, 112, 399/121, 301, 299, 312; 347/138, 152, 115, 116, 118

(56) References Cited

U.S. PATENT DOCUMENTS 5,875,380 A 2/1999 Iwata et al.
6,148,168 A * 11/2000 Hirai et al. ..... 399/301

FOREIGN PATENT DOCUMENTS

JP 4-184360 7/1992
JP 2889368 B2 2/1999
JP 11-327416 11/1999

OTHER PUBLICATIONS

Patent Abstracts of Japan, vol. 015, No. 424 (P–1268), Oct. 28, 1991, JP 03 174173, Jul. 29, 1991.
Patent Abstracts of Japan, vol. 018, No. 256 (P–1738), May 16, 1994, JP 06 035288, Feb. 10, 1994.
Patent Abstracts of Japan, vol. 016, No. 396 (P–1407), Aug. 21, 1992, JP 04 130391, May 1, 1992.

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus of the present invention includes an apparatus body to which a conveying unit is removably mounted. A belt is used to convey a paper sheet. A sensor includes a light emitting portion for emitting light toward the belt and a photosensitive portion to which the light from the belt is incident. One of the light emitting portion and photosensitive portion is mounted on the conveying unit while the other is mounted on the apparatus body. A positioning device causes, in interlocked relation to the mounting operation of the conveying unit to the apparatus body, the optical portion mounted on the apparatus body to move in accordance with the position and/or the configuration of the conveying unit and be positioned relative to the belt. Therefore, only the conveying unit and optical portion should be positioned relative to each other.

14 Claims, 9 Drawing Sheets

IMAGE FORMING APPARATUS INCLUDING INTERLOCKING LIGHT EMITTING AND RECEIVING PORTIONS

BACKGROUND OF THE INVENTION

The present invention relates to an image forming apparatus capable of setting up an adequate positional relation between images of different colors to be superposed on each other on a paper sheet and thereby insuring an attractive color image free from color deviation or irregular density.

A copier, printer or similar image forming apparatus includes various structural parts assembled together. Therefore, assembly errors between the parts and drive errors are apt to cause an image to be formed on a paper sheet at a position other than expected one. Particularly, in a full-color image that is a laminate of toner images of different colors, positional deviation between the images appears as conspicuous color deviation and degrades image quality to a critical degree. Moreover, to form a full-color image, a plurality of image carriers each are assigned to a particular color and therefore aggravate color deviation. A solution to this problem is extremely difficult to achieve.

Technologies relating to the present invention are disclosed in, e.g., Japanese Patent Laid-Open Publication Nos. 6-35288, 11-327416 and 4-190255 (Japanese Patent No. 2,889,368).

SUMMARY OF THE INVENTION

It is therefore an object of the present invention to provide an image forming apparatus capable of setting up, when images of different colors are superposed, an accurate positional relation between separate structural members and therefore an adequate positional relation between the images.

An image forming apparatus of the present invention includes an apparatus body to which a conveying unit is removably mounted. A belt is used to convey a paper sheet. A sensor includes a light emitting portion for emitting light toward the belt and a photosensitive portion to which the light from the belt is incident. One of the light emitting portion and photosensitive portion is mounted on the conveying unit while the other is mounted on the apparatus body. A positioning device causes, in interlocked relation to the mounting operation of the conveying unit to the apparatus body, the optical portion mounted on the apparatus body to move in accordance with the position and/or the configuration of the conveying unit and be positioned relative to the belt.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
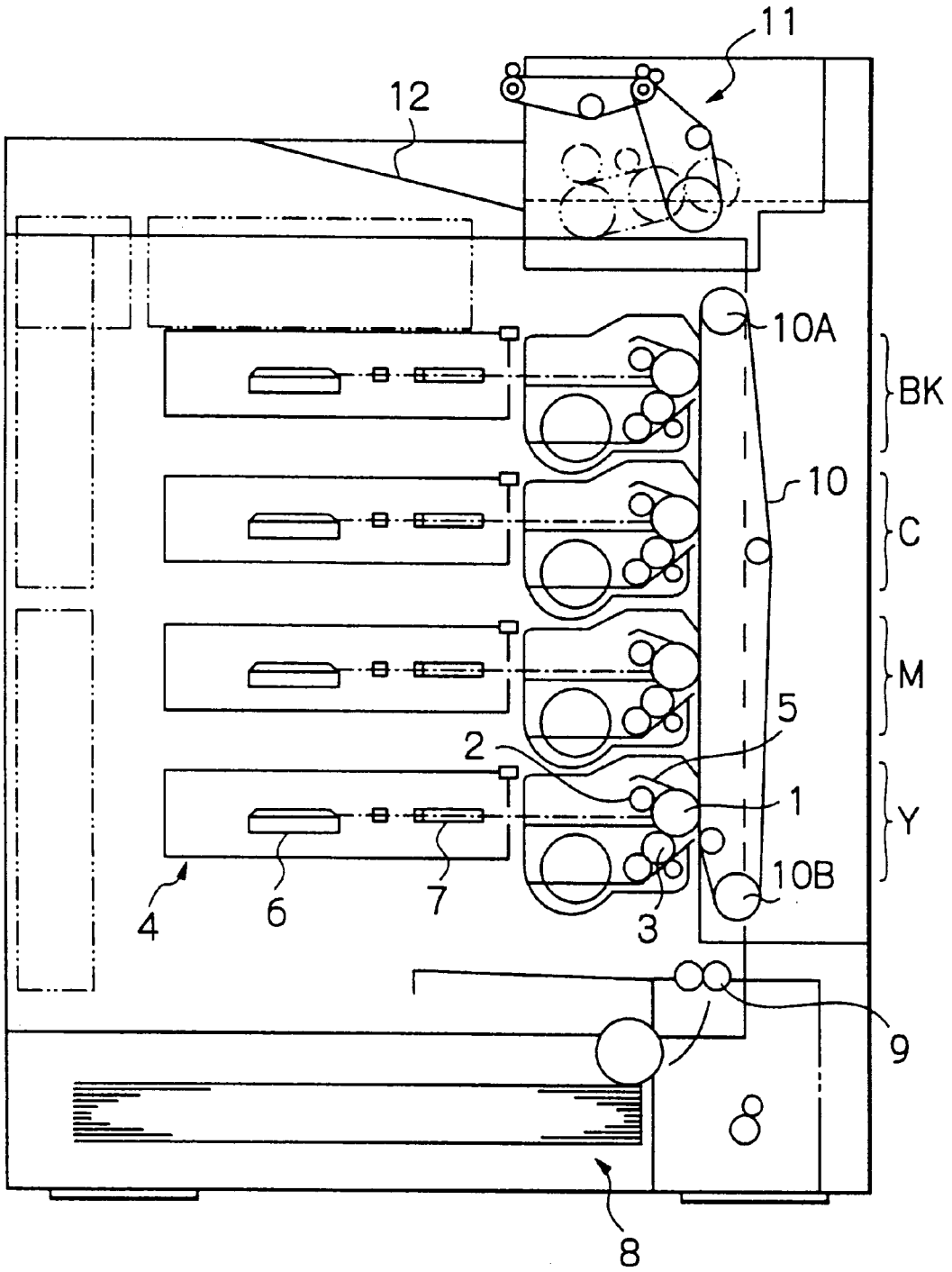
Fig. 1 PRIOR ART
FIG. 1 is a view showing an image forming apparatus embodying the present invention.

To better understand the present invention, reference will be made to a conventional full-color image forming apparatus, shown in FIG. 1. As shown, the image forming apparatus includes a plurality of image forming sections arranged along a paper transport path. The image forming sections each transfer a toner image of particular color to a paper sheet brought thereto. As a result, a full-color is formed on the paper sheet. Each image forming section includes a photoconductive portion implemented as a drum 1. A charger 2, an exposing device 4, a developing device 3 and a cleaning device 5 are sequentially arranged around the drum 1 in a direction in which the drum 1 is rotatable (counterclockwise direction in FIG. 1). All image forming sections are identical in configuration. Cyan, yellow, magenta and black, which are complementary to separated colors, each are assigned to particular one of the image forming sections.

The charger 2 uniformly charges the surface of the drum 1 while the exposing device 4 exposes the charged surface of the drum 1 with a pattern corresponding to a desired image or optically writes the pattern on the drum 1. As a result, a latent image is electrostatically formed on the drum 1. The developing device 3 develops the latent image with toner to thereby form a corresponding toner image. The toner image is transferred from the drum 1 to a paper sheet. The cleaning device 5 cleans the toner left on the drum 1 after the image transfer.

Specifically, a personal computer, for example, not shown in FIG. 1 sends color-separated image signals to an image processing section, not shown, included in the image forming apparatus. The image processing section transforms the input image signals to black (BK), magenta (M), yellow (Y) and cyan (C) image data on the basis of intensity levels of the image signals. The exposing device 4 performs exposure or optical writing in accordance with the image data. In FIG. 1, portions of the image forming apparatus each including a particular drum 1 for forming an image of particular color are labeled Y, M, C and BK.

The exposing device 4 is implemented as a laser scanner including a laser not shown. A polygonal scanner 6 in rotation steers a laser beam issuing from the laser, so that an image is written on the drum 1. The axial direction of the drum 1 and the direction perpendicular to the axial direction are a main scanning direction and a subscanning direction, respectively.

A paper sheet S is fed from a paper feeder 8 via a registration roller pair 9 and then conveyed by a belt 10. To sequentially superpose toner images of different colors, the duration of exposure is set such that the timing for the belt 10 to convey the paper sheet S to each image transfer position and the timing for an image formed on each drum 1 to be moved to the image transfer position are identical throughout the different colors. A fixing device 11 fixes a full-color image completed on the paper sheet S. The paper sheet S is then driven out of the apparatus to a tray or similar paper discharge portion.

The problem with the above-described image forming apparatus is that the toner images of different colors are apt to deviate from each other on the paper sheet S due to various errors particular to the apparatus. The errors include errors in the distance between the axes of nearby drums 1, errors in the parallelism of the drums 1, positional errors of optics including mirrors, and errors in write start timing. Such errors occur due to the replacement and maintenance of image forming units, transport of the product and so forth despite initial adjustments. Further, the errors vary due to the thermal expansion of mechanisms that may occur after only several images have been formed on consecutive paper sheets. Adjustments must therefore be made in a short range.

Japanese Patent Laid-Open Publication No. 6-35288, for example, teaches a solution to the problem described above. The solution uses a particular toner mark and a sensor for sensing it. Image positions are adjusted color by color on the basis of the toner mark sensed by the sensor. The toner mark is focused on a CCD (Charge Coupled Device) line sensor via a lens.

On the other hand, a current trend in the imaging art is toward an image forming apparatus in which the various process portions described above, e.g., portions around the drums, image transfer portions and fixing portion each including expendables are implemented as removable cartridges. This configuration is successful to promote easy maintenance of the apparatus. Particularly, as for printers and facsimile apparatuses for personal use, a simple mechanism that allows the user of the apparatus to mount and dismount the cartridges is essential.

Assume that the above cartridges each are removably mounted to the body of the image forming apparatus, and that a sensor responsive to color deviation is entirely or partly mounted on the body. Then, the sensor and belt 10 are separate from each other because the belt 10 is included in an image transferring and conveying unit. This brings about a problem that the sensor and belt 10 cannot be accurately positioned relative to each other.

Figure 6:
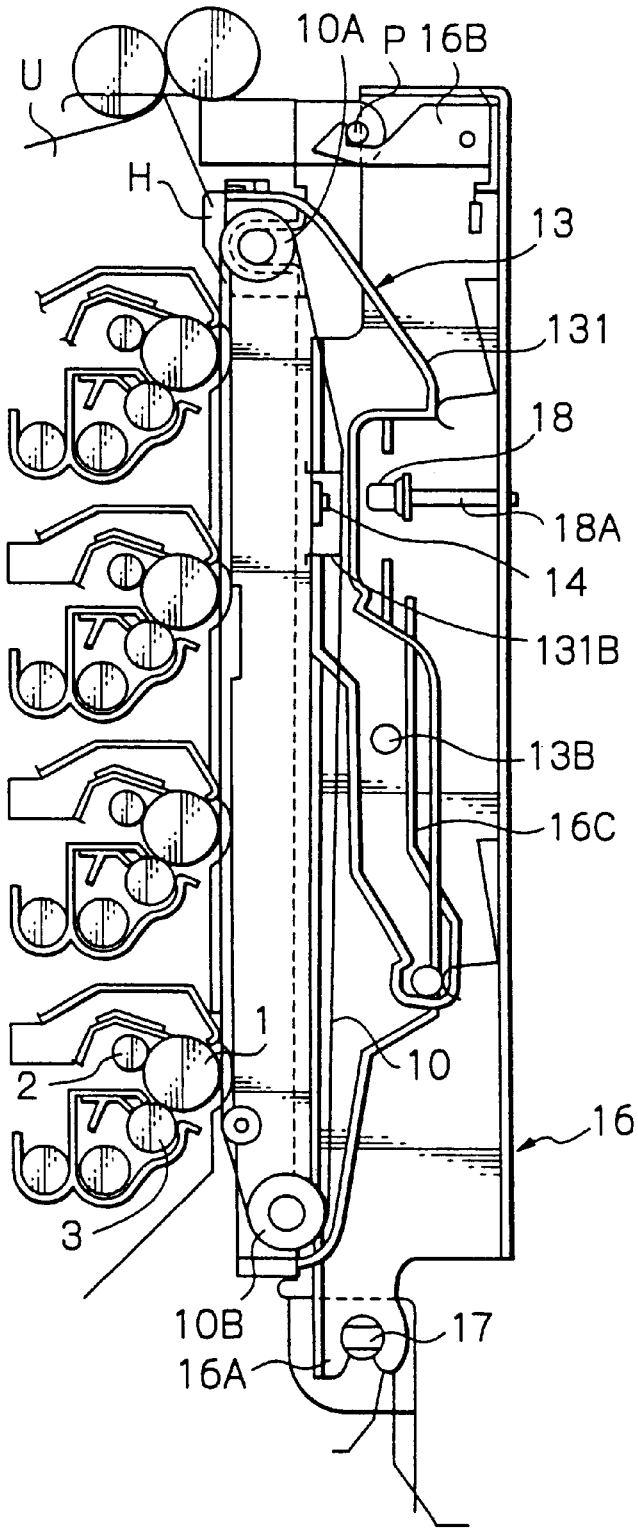
FIG. 6 is a view showing a specific conventional image transferring and conveying unit and arrangements for mounting it.

FIG. 6 shows a specific configuration of the above image transferring and conveying unit that is removable from the body of the image forming apparatus. As shown, the image transferring and conveying unit, generally 13, includes a pair of belt rollers 10A and 10B (also shown in FIG. 1) and the belt 10 passed over the belt rollers 10A and 10B. The belt 10 is formed of a material capable of transmitting light.

The belt 10 supports a paper sheet at a preselected position thereof either electrostatically or mechanically. The belt 10 allows images of different colors to be transferred from the drums 1 to the paper sheet one above the other and conveys the paper sheet carrying the resulting full-color image thereon to the fixing device 11, FIG. 1. A cover 131 covers the portions of the belt 10 passed over the belt rollers 10A and 10B. An opening 131A (see FIG. 2) is formed in part of the cover 131, so that the belt 10 is exposed to the outside via the opening 131A.

The sensor is made up of a light emitting portion 18 and a photosensitive portion 14 respectively mounted on a cassette 16, which will be described later, and the image transferring and conveying unit 13. The photosensitive portion 14 adjoins the opening 131A and faces the light emitting portion 18. Guide rails 131B are mounted on the image transferring and conveying unit 13 for positioning the belt 10 that faces the photosensitive portion 14. The guide rails 131B set an optical distance. The photosensitive portion 14 includes a circuit board, not shown, having a photosensor, an amplifier and so forth mounted thereon. The sensor senses a toner mark (T, FIGS. 7A through 10) formed on the belt 10. The sensor forms part of means for controlling the drive of the belt 10 such that toner images are transferred from the drums 1 to a paper sheet in accurate register.

Figure 2:
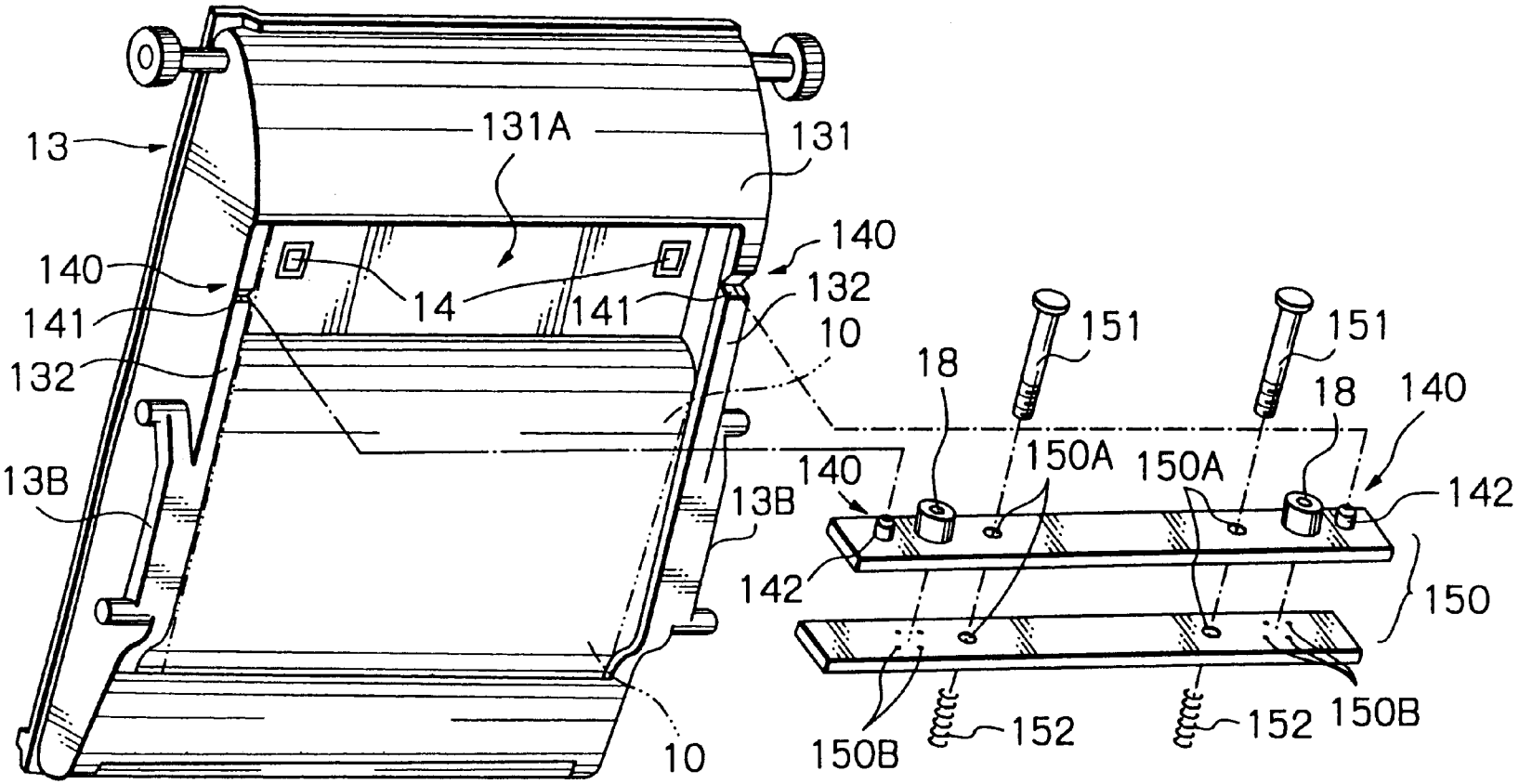
FIG. 2 is an isometric view showing an image transferring and conveying unit included in the illustrative embodiment.

Guide rails 13B are mounted on the image transferring and conveying unit 13, and each has lugs extending outward in the widthwise direction perpendicular to the direction of movement of the belt 10. In FIG. 6, the guide rails 13B are represented only by the lugs. A more specific structure of the guide rails 13B is shown in FIG. 2. The guide rails 13B each are removably mounted to a mount portion 16C included in the cassette 16.

The cassette 16 is hinged to the apparatus body and supports the image transferring and conveying unit 13. Specifically, the cassette 16, facing the drums 1, includes generally U-shaped mating portions 16A open downward. The mating portions 16A mate with pins 17 included in the apparatus body, so that the cassette 16 is openable by being rotated about the pins 17. A stop member, not shown, limits the opening angle of the cassette 16.

A lock member 16B extends sideways from the upper portion of the cassette 16. When the cassette 16 is closed, the lock member 16B engages with a lock portion P included in the apparatus body and thereby locks the cassette 16 to the apparatus body. The mount portions 16C, which are generally U-shaped and open upward, are formed on the sides of the cassette 16 in order to receive the guide rails 13B of the image transferring and conveying unit 13.

An opening for allowing the image transferring and conveying unit 13 to be mounted and dismounted is formed in the top of the cassette 16, as seen in FIG. 6. The light emitting portion 18 is disposed in the cassette 16 in such a manner as to face the photosensitive portion 14 of the image transferring and conveying unit 13 when the unit 13 is inserted into the cassette 16 via the above opening. Specifically, the light emitting portion 18 is affixed to the free end of a support screw 18A that is, in turn, affixed to the cassette 16. Also shown in FIG. 6 are a support portion H supporting a drive mechanism assigned to the belt roller or drive roller 10A, and a side wall U included in the apparatus body.

In an image forming apparatus including the above-described members, positional accuracy between the members is, in many cases, determined by the multiplication of the positional errors of the individual members. After the assembly, therefore, substantial errors are apt to occur due to the multiplication of the errors between the members, degrading positional accuracy to a critical degree. It follows that in a separately arranged sensor configuration, e.g., the conventional configuration described above, assembly errors make color deviation noticeable when toner images of different colors are superposed on each other.

Figure 7B:
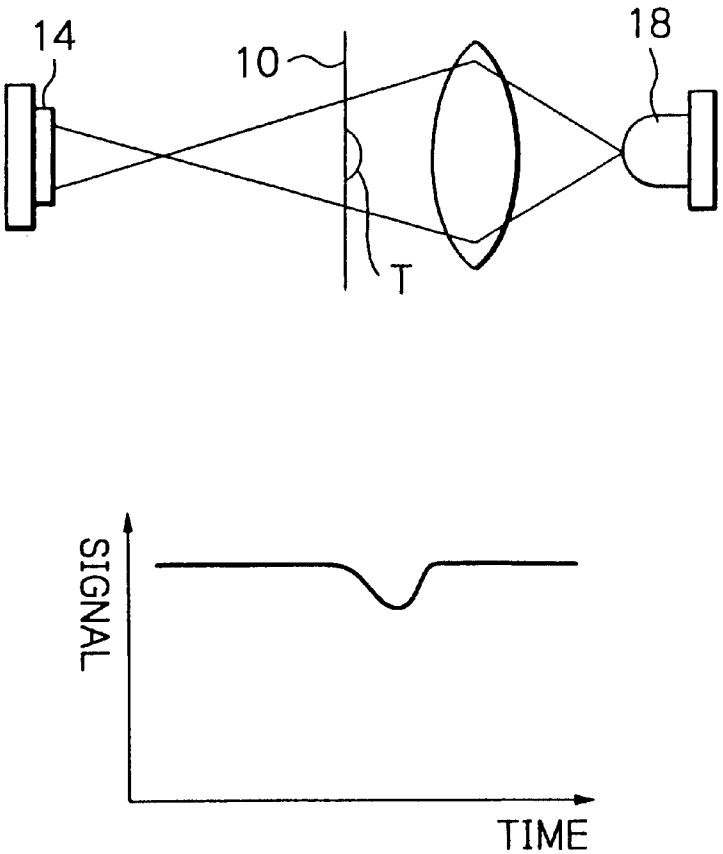
FIGS. 7A and 7B are views respectively showing a regular and an irregular positional relation between a light emitting portion and a photosensitive portion shown in FIG. 6.
Figure 7A:
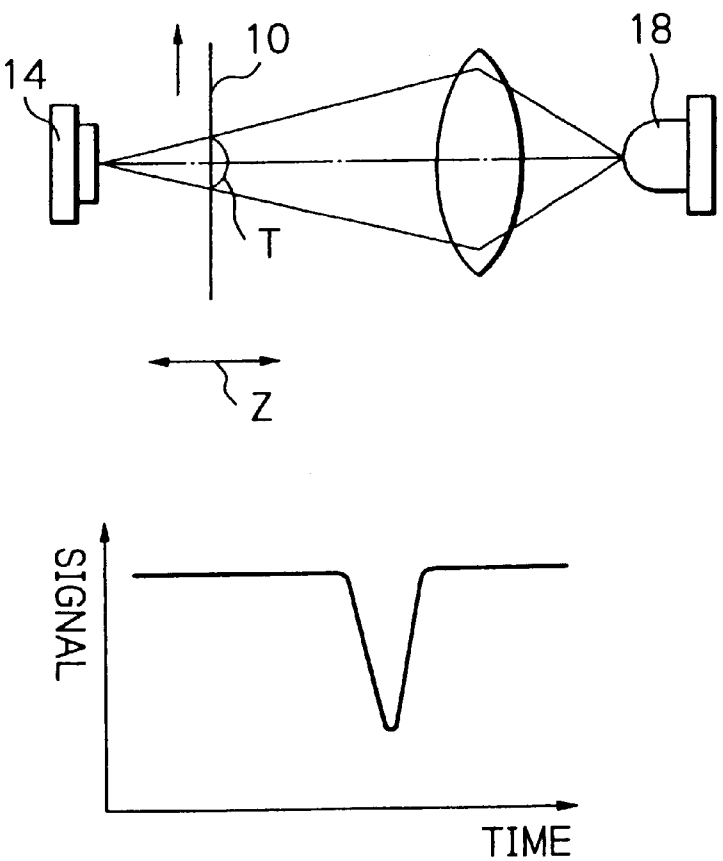

The relation between the belt 10 and the sensor will be described more specifically with reference to FIGS. 7A through 10. FIG. 7A shows an accurate positional relation between the light emitting portion 18 and photosensitive portion 14 and the resulting signal output from the photosensitive portion 14. As shown in FIG. 7B, when the light emitting portion 18 and photosensitive portion 14 are not aligned on the optical axis, i.e., in a direction Z, the focus is shifted from the portion 14. As a result, the signal output from the photosensitive portion 14 and representative of the toner mark T does not have a sharp waveform. Such a signal cannot be compared with a preselected threshold and therefore brings about an error. This prevents the drive of the belt 10 from being accurately controlled.

Figure 8B:
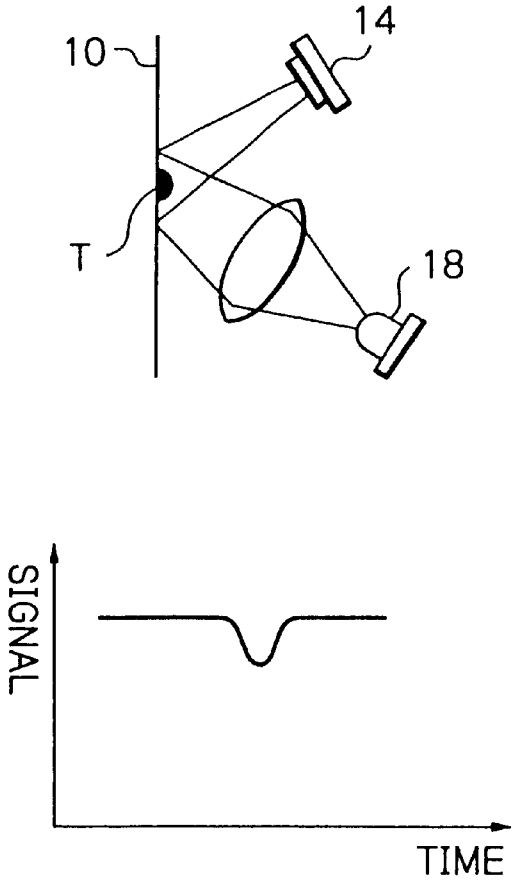
FIGS. 8A and 8B are views respectively showing another regular positional relation and another irregular positional relation between he light emitting portion and the photosensitive portion.
Figure 8A:
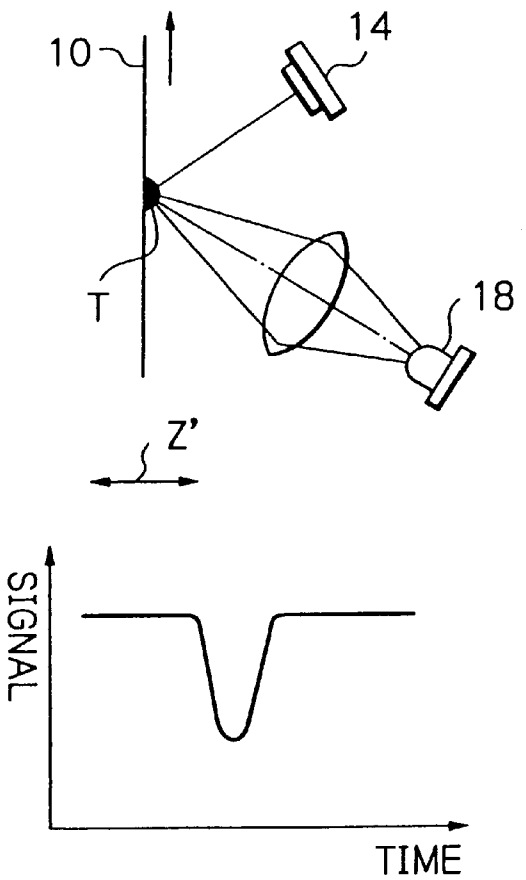

As shown in FIGS. 8A and 8B, assume that the photosensitive portion 14 senses light emitted from the light emitting portion 18 and then reflected by the belt 10, i.e., use is made of a reflection type sensor. As shown in FIG. 8A, when the positional relation between the light emitting portion 18 and photosensitive portion 14 is accurate, the signal output from the portion 14 and representative of the toner mark T has a sharp waveform. As shown in FIG. 8B, when the focal distance is shifted in a direction Z', the resulting output of the photosensitive portion 14 does not have a sharp waveform.

Figure 10:
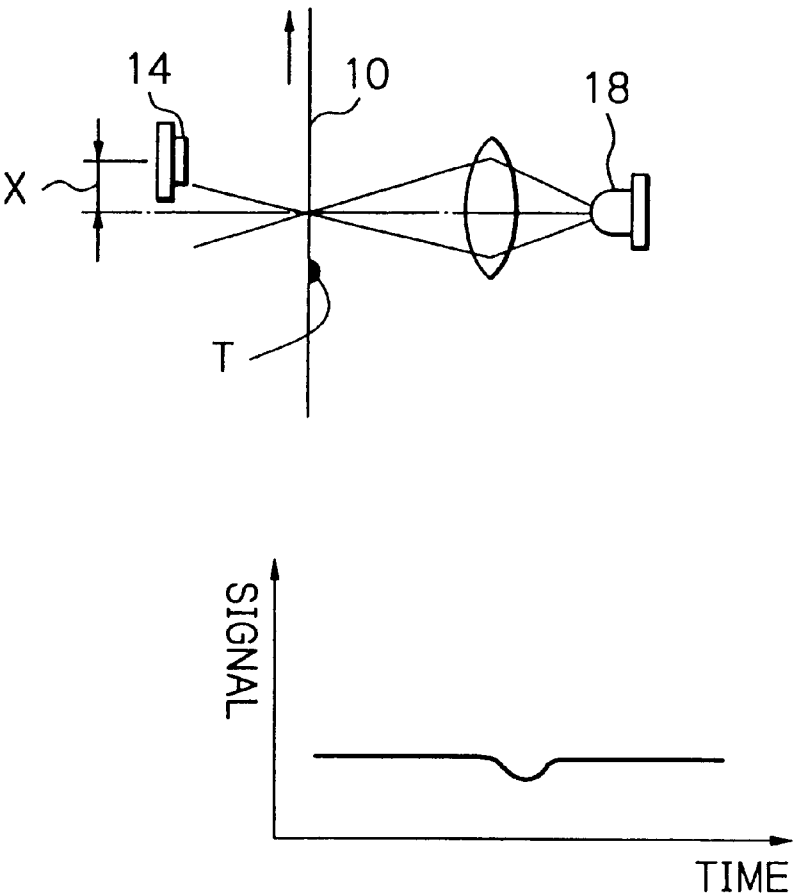
FIGS. 9 and 10 are views each showing another specific positional relation between the light emitting portion and the photosensitive portion.
Figure 9:
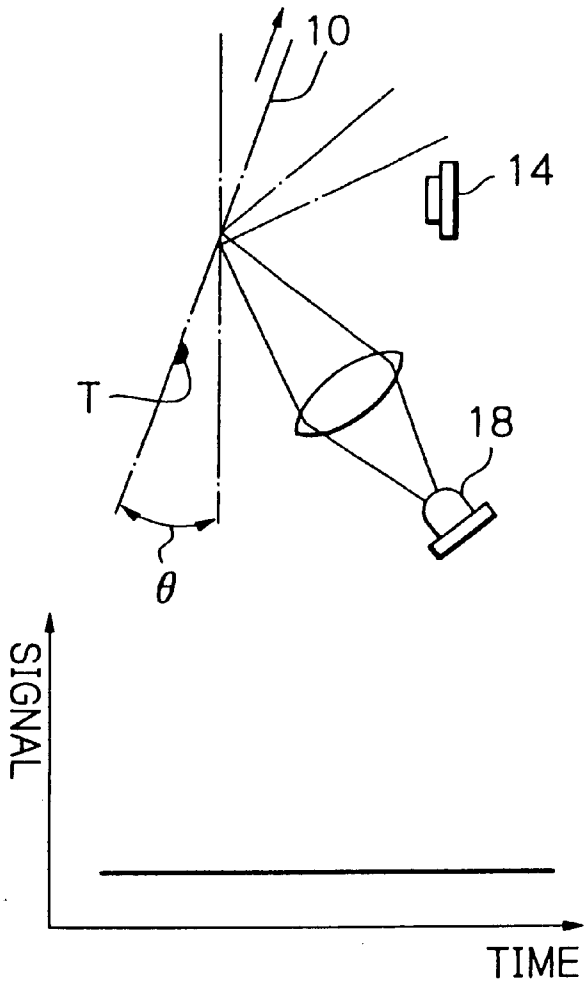

Further, as shown in FIG. 9, assume that the light emitting portion 18 and photosensitive portion 14 constitute a reflection type sensor, and that the belt 10 is inclined by an angle θ relative to the two portions 18 and 14. Then, the light issuing from the light emitting portion 18 does not reach the photosensitive portion 18, resulting in an error. As shown in FIG. 10, even in the transmission type sensor, an error X in the relative position of the light emitting portion 18 and photosensitive portion 14 in the direction of movement of the belt 10 prevents the light issuing from the portion 18 from reaching the portion 14.

As stated above, when parts separate from each other are assembled together, the positional accuracy of the individual part effects the positions of images to be superposed on each other, resulting in a defective image.

A preferred embodiment of the image forming apparatus in accordance with the present invention will be described hereinafter. The illustrative embodiment is also implemented as the image forming apparatus shown in FIG. 1 and constructed to form a full-color image via the belt 10. Characteristic features of the illustrative embodiment will be described with reference to FIG. 2. The image transferring and conveying unit 13 shown in FIG. 2 is applicable to the construction shown in FIG. 6 except for arrangements unique to the illustrative embodiment. In FIG. 2, structural portions identical with the structural portions shown in FIG. 6 are designated by identical reference numerals.

In FIG. 2, the belt 10 of the image transferring and conveying unit 13 is formed of a material capable of transmitting light. The cover 131 is formed with the opening 131A such that the belt 10 is exposed to the outside via the opening 131A. The cover 131 is mounted on opposite side walls 132 included in the image transferring and conveying unit 13. Part of positioning means 140 is formed in the side walls 132 at opposite sides of the opening 131A.

Specifically, the positioning means 140 is made up of engaging portions 141 included in the image transferring and conveying unit 13 and pins 142 studded on the openable cassette 16, FIG. 6. The engaging portions 141 are implemented as a hole and a groove respectively formed in the side walls 132 of the cassette 13. The pins 142, which are implemented as lugs, are respectively engageable with the hole and groove of the engaging portions 141. If desired, both of the engaging portions 141 may be implemented as holes or any other suitable means capable of preventing the pins 142 from being displaced.

The illustrative embodiment includes two light emitting portions 18 mounted on the cassette 16 and two photosensitive portions 14 mounted on the image transferring and conveying unit 13. The engaging portions 141 and pins 142 face each other such that when the image transferring and conveying unit 13 is inserted into the cassette 16, the photosensitive portions 14 and light emitting portions 18 face each other. Stated another way, the engaging portions 141 and pins 142 are respectively positioned in the vicinity of the photosensitive portions 14 and light emitting portions 18, which are optical members cooperative with each other. The portions 14 and 18 are therefore positioned relative to each other on the basis of the engagement of the engaging portions 141 and 142 at positions that have the greatest influence on the relative position.

A support member 150 is mounted on the cassette 16 and supports the light emitting portions 18 thereon. The support member 150 is implemented by two superposed plates each having a length corresponding to the width of the belt 10. One of the two plates is a support plate supporting the pins 142 while the other plate is a terminal plate assigned to the light emitting portions 18. The pins 142 are positioned in the vicinity of opposite ends of the support member 150 in the lengthwise direction of the member 150. The light emitting portions 18 are positioned inward of the pins 142 in the lengthwise direction of the support member 150.

Each pin 142 has a frustoconical configuration and can be easily centered in the associated engaging portion 141. The centers of the pins 142 are aligned with the centers of the light emitting portions 18 in the widthwise direction of the support member 150 perpendicular to the lengthwise direction of the same. This is also true with the engaging portions 141 of the image transferring and conveying unit 13 and photosensitive portions 14. In a design drawing, the center lines of the engaging portions 141 and those of the pins 142 align with each other.

Figure 3:
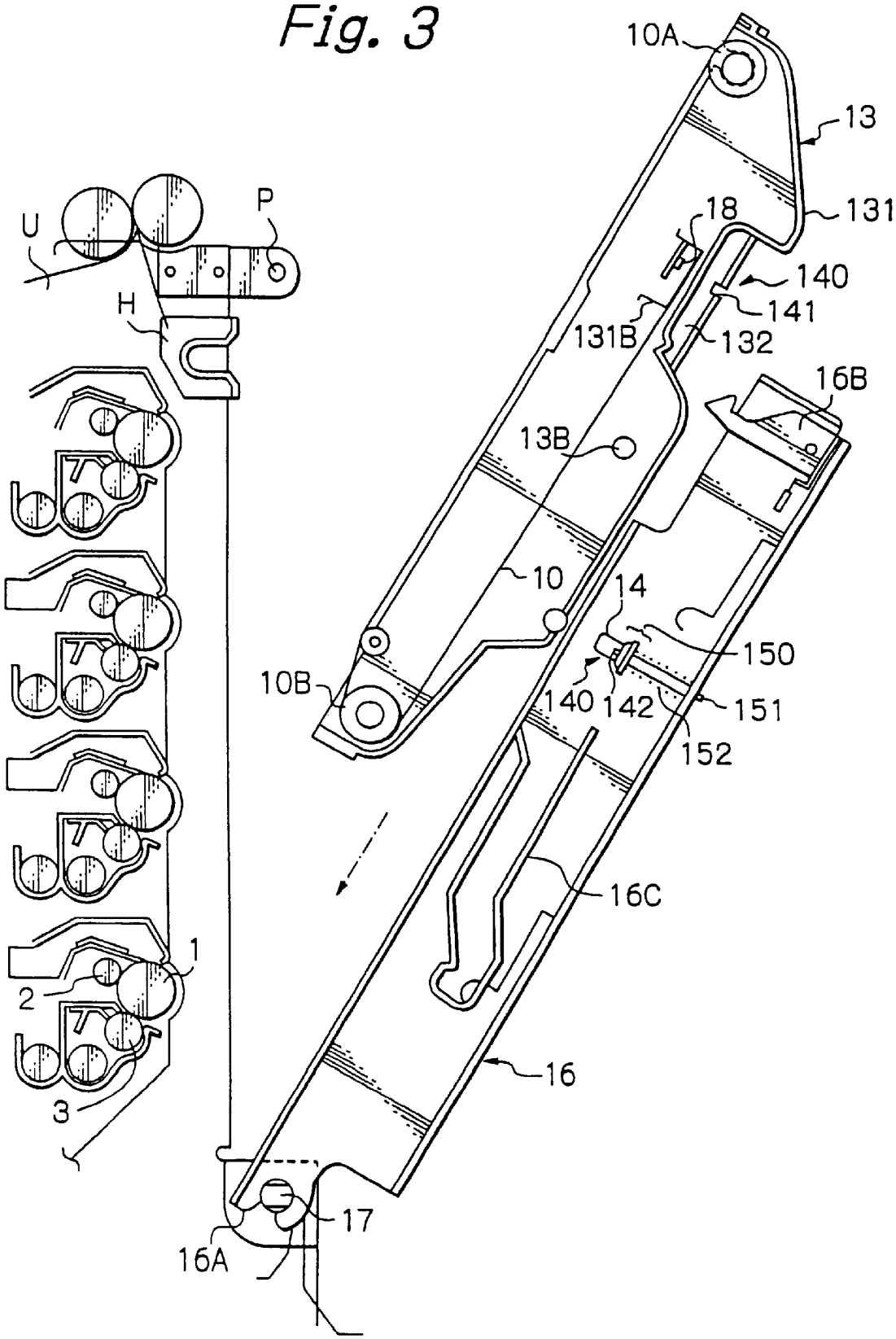
FIGS. 3 through 5 are views demonstrating how the image transferring and conveying unit is mounted to an apparatus body.

Support pins 151 are each passed through a particular hole 150A formed in the support member 150, so that the support member 150 is movable toward and away from the photosensitive portions 14. The holes 150A have a diameter slightly larger than the outside diameter of the support pins 151 and allow the support member 150 to move along the support pins 151. The ends of the support pin 151 close to the photosensitive portions 14 are implemented as stepped heads. As shown in FIG. 3, the other end of each support pin 151 is affixed to the cassette 16.

As also shown in FIG. 3, coil springs or similar resilient members 152 are preloaded around the support pins 151 between the rear of the support member 150 remote from the heads of the support pins 151 and the inner surface of the cassette 16. The coil springs 152 bias the support member 150 such that the support member 150 abuts against the heads of the support pins 151. Further, the difference in diameter between the holes 150A and the support pins 151 allows the support member 150 to move in the front-and-rear and right-and-left directions and in the composite directions thereof in a plane extending in the lengthwise direction of the support member 150.

As shown in FIG. 2, apertures 150*b* are additionally formed in the support member 150. Pin terminals, not shown, extending out from the light emitting portions 18 are passed through the apertures 150*b* for electrical connection.

The operation of the illustrative embodiment will be described with reference to FIGS. 3 through 5. FIG. 3 shows a condition wherein the transferring and conveying unit 13 is being mounted to the cassette 16. As shown, after the cassette 16 has been opened away from the side walls U of the apparatus body, the guide rails 13B of the unit 13 are inserted in the mount portions 16C of the cassette 16C. The light emitting portions 18 and photosensitive portions 14 are not positioned relative to each other until the pins 142 face the engaging portions 141.

Figure 4:
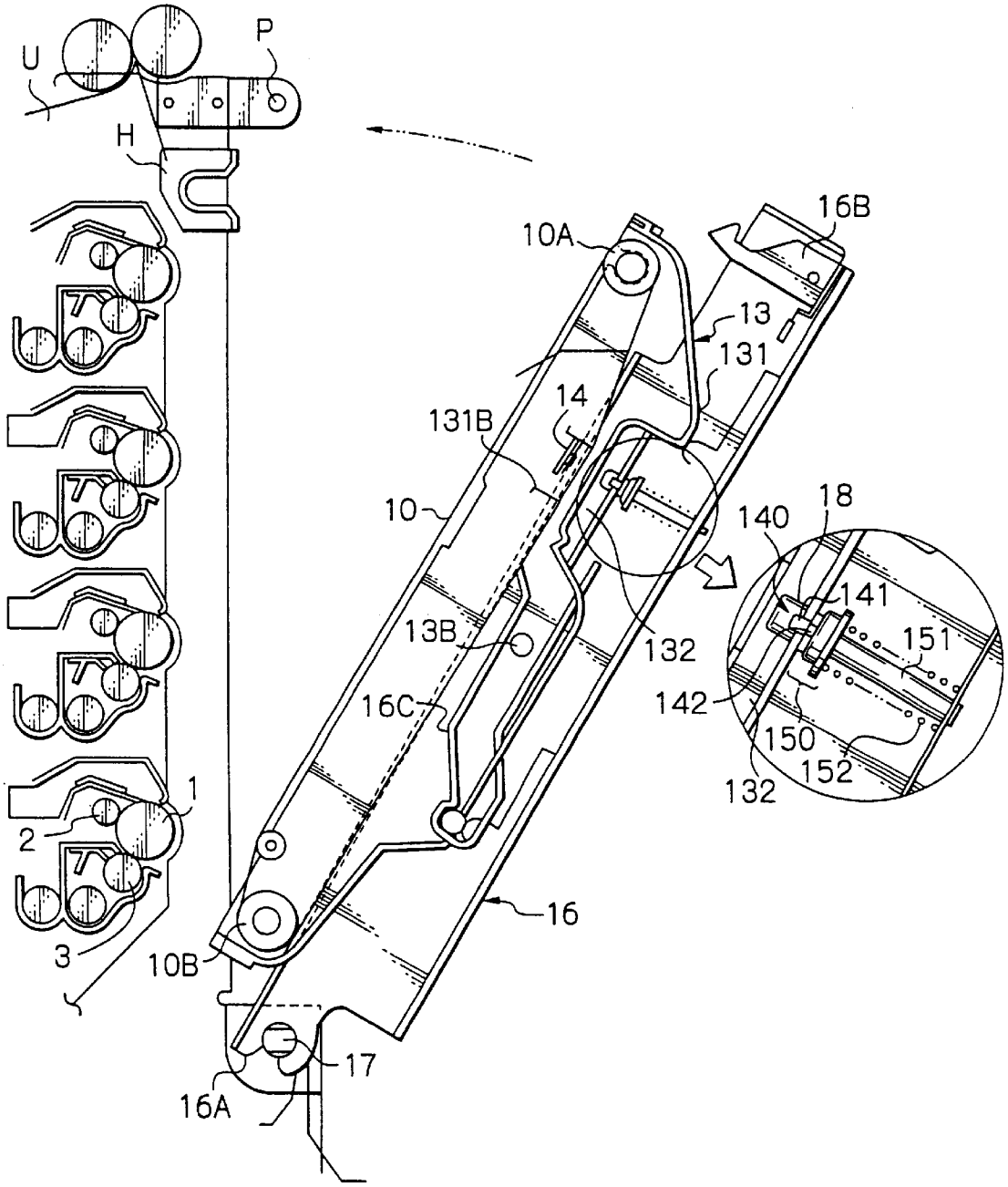

As shown in FIG. 4, just before the unit 13 is fully mounted to the cassette 16, the pins 142 mate with the engaging portions 141 due to the configuration of the guide rails 13B and that of the mount portions 16C. At this instant, one of the pins 142 enters the associated engaging portion or hole 141 and is centered therein.

While the above pin 142 is being centered in the hole 141, the support member 150 is displaced in the centering direction due to the difference in diameter between the support pins 151 and the holes 150A. As a result, the pins 142 are displaced in interlocked relation to the insertion of the unit 13 to the cassette 16, which forms part of the apparatus body, until the centers of the pins 142 align with the centers of the engaging portions 141. In this manner, when the pins 142 are displaced into alignment with the engaging portions 141 in accordance with the positional relation between the unit 13 and the apparatus body, the light emitting portions 18 whose centers are aligned with the centers of the pins 142 are brought into alignment with the photosensitive portions 14.

Figure 5:
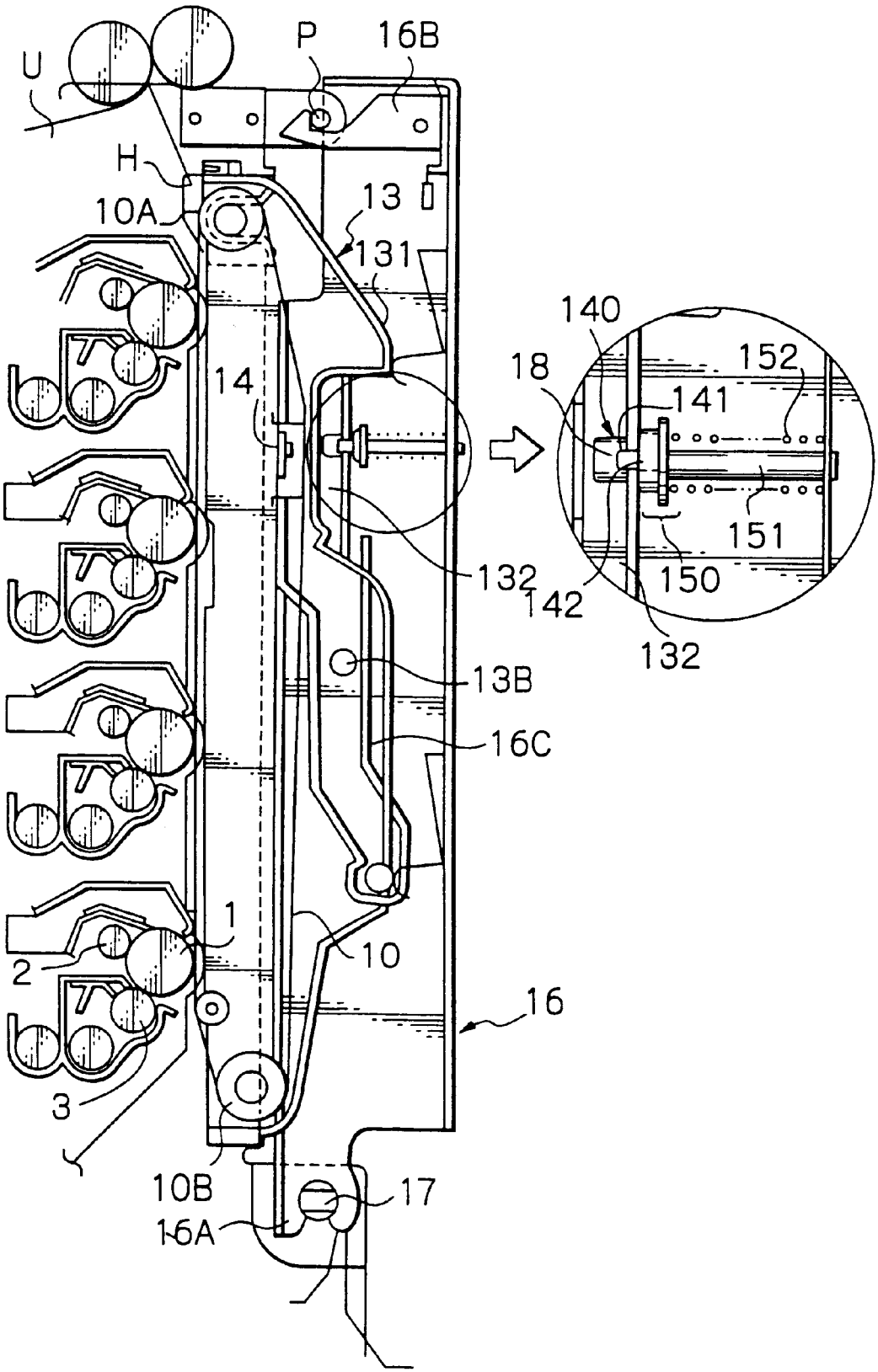

As shown in FIG. 5, the cassette 16 loaded with the unit 13 is closed toward the apparatus body. Even during this movement of the cassette 16, the centers of the light emitting portions 18 and those of the photosensitive portions 14 are held in alignment because the pins 142 continuously mate with the engaging portions 141.

As stated above, in the illustrative embodiment, the centers of the light emitting portions 18 and those of the photosensitive portions 14 are brought into alignment at positions where they are supported, i.e., without regard to errors in the positions of many other parts. The sensors can therefore accurately sense the toner mark T formed on the belt 10.

While the belt 10 of the illustrative embodiment is formed of a material capable of transmitting light, it may be formed of a material capable of reflecting light, in which case use will be made of a reflection type sensor. Further, the sensor made up of the light emitting portion and photosensitive portion may even be used as a toner concentration sensor for controlling image density or a paper sensor for sensing a paper sheet being conveyed.

In summary, it will be seen that the present invention provides an image forming apparatus having various unprecedented advantages, as enumerated below.

(1) When a conveying unit is mounted to an apparatus body, positioning means causes an optical member mounted on the apparatus body to be displaced in accordance with the position or the configuration of the conveying unit. That is, only the conveying unit and optical member should be positioned relative to each other. Therefore, even when errors in positional relation ascribable to the multiplication of errors of individual parts and assembly errors is noticeable, optical members constituting a transmission or reflection type sensor can have their centers accurately aligned.

(2) The positioning means includes support means displaceable in accordance with the mating condition of engaging portions. The support means allows the centers of the optical members, which are respectively mounted on the conveying unit and apparatus body, to be displaced relative to each other until they align with each other.

(3) A toner mark formed on a belt can be accurately sensed because the sensor is optically positioned relative to the toner mark with accuracy.

(4) When the belt is used to form a full-color image on a paper sheet, the accurate optical position of the sensor relative to the toner mark makes a positional relation between images to be superposed adequate and thereby insures an attractive full-color image free from color deviation or irregular density.

Various modifications will become possible for those skilled in the art after receiving the teachings of the present disclosure without departing from the scope thereof.

What is claimed is:

1. An image forming apparatus comprising:

an apparatus body having a removably mounted conveying unit with a belt for conveying a paper sheet;

sensor means including a light emitting portion for emitting light toward said belt and a photosensitive portion for receiving light transmitted through the belt, wherein one of said light emitting portion and said photosensitive portion is mounted on said conveying unit while the other of said light emitting portion and said photosensitive portion is mounted on said apparatus body; and positioning means for causing, in interlocked relation to a mounting operation of said conveying unit to said apparatus body, said light emitting portion or said photosensitive portion mounted on said apparatus body to move in accordance with at least one of a position and a configuration of said conveying unit and be positioned relative to said belt.

2. An apparatus as claimed in claim 1, wherein said positioning means comprises:

an engaging portion engageable with said apparatus body when said conveying unit is mounted to said apparatus body; and support means supporting said light emitting portion or said photosensitive portion mounted on said apparatus body, and displaceable in accordance with an engaging condition of said engaging portion.

3. An apparatus as claimed in claim 1, wherein said light emitting portion and said photosensitive portion face each other with the intermediary of said belt, constituting transmission type sensor means.

4. An apparatus as claimed in claim 1, wherein said sensor means comprises an image position sensor responsive to a toner mark formed on said belt.

5. An apparatus as claimed in claim 1, wherein said sensor means comprises a toner concentration sensor responsive to a toner mark formed on said belt.

6. An apparatus as claimed in claim 1, wherein said sensor means comprises a paper sensor responsive to a paper sheet being conveyed by said belt.

7. An apparatus as claimed in claim 1, wherein said belt is used to form a color image that is a laminate of toner of different colors.

8. An image forming apparatus comprising:

an apparatus body having a removably mounted conveying unit with a belt configured to convey a paper sheet;

a sensor including a light emitting portion configured to emit light toward said belt and a photosensitive portion configured to receive light transmitted through the belt, wherein one of said light emitting portion and said photosensitive portion is mounted on said conveying unit while the other of said light emitting portion and said photosensitive portion is mounted on said apparatus body; and a positioning device configured to cause, in interlocked relation to a mounting operation of said conveying unit to said apparatus body, said light emitting portion or said photosensitive portion mounted on said apparatus body to move in accordance with at least one of a position and a configuration of said conveying unit and be positioned relative to said belt.

9. An apparatus as claimed in claim 8, wherein said positioning device comprises:

an engaging portion engageable with said apparatus body when said conveying unit is mounted to said apparatus body; and a support member supporting said light emitting portion or said photosensitive portion mounted on said apparatus body, and displaceable in accordance with an engaging condition of said engaging portion.

10. An apparatus as claimed in claim 8, wherein said light emitting portion and said photosensitive portion face each other with the intermediary of said belt, constituting a transmission type sensor.

11. An apparatus as claimed in claim 8, wherein said sensor comprises an image position sensor responsive to a toner mark formed on said belt.

12. An apparatus as claimed in claim 8, wherein said sensor comprises a toner concentration sensor responsive to a toner mark formed on said belt.

13. An apparatus as claimed in claim 8, wherein said sensor comprises a paper sensor responsive to a paper sheet being conveyed by said belt.

14. An apparatus as claimed in claim 8, wherein said belt is used to form a color image that is a laminate of toner of different colors.

* * * * *